US010610769B2

(12) United States Patent
Adams

(10) Patent No.: US 10,610,769 B2
(45) **Date of Patent: *Apr. 7, 2020**

(54) MODIFIED ROULETTE WHEEL APPARATUS AND ASSOCIATED WAGERING GAME METHODS

(71) Applicant: Timothy Adams, Las Vegas, NV (US)

(72) Inventor: Timothy Adams, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/351,445

(22) Filed: Mar. 12, 2019

(65) Prior Publication Data

US 2019/0209916 A1 Jul. 11, 2019

Related U.S. Application Data

(63) Continuation of application No. 15/111,815, filed as application No. PCT/US2015/011665 on Jan. 15, 2015, now Pat. No. 10,226,690.

(60) Provisional application No. 61/927,835, filed on Jan. 15, 2014.

(51) Int. Cl.

| | |
|---|---|
| ***A63F 5/04*** | (2006.01) |
| ***A63F 5/00*** | (2006.01) |
| ***A63F 5/02*** | (2006.01) |

(52) U.S. Cl.

CPC ..... *A63F 5/007* (2013.01); *A63F 5/02* (2013.01); *A63F 5/0094* (2013.01); *A63F 5/04* (2013.01); *A63F 5/043* (2013.01)

(58) Field of Classification Search

CPC ..... A63F 5/007; A63F 5/0094; A63F 5/02; A63F 5/04; A63F 5/043

USPC ..... 273/142 E, 142 F, 142 D, 142 G, 142 H, 273/142 HA, 142 J, 142 JA, 142 JB, 273/142 JC, 142 JD

See application file for complete search history.

(56) References Cited

U.S. PATENT DOCUMENTS

| | | | | |
|---|---|---|---|---|
| 5,636,838 | A * | 6/1997 | Caro | A63F 5/007 273/142 E |
| 6,217,022 | B1 * | 4/2001 | Astaneha | A63F 5/043 273/138.1 |
| 7,571,910 | B1 * | 8/2009 | Launzel | A63F 5/0094 273/138.1 |
| 7,926,808 | B1 * | 4/2011 | Gullotta | A63F 5/007 273/142 F |
| 10,226,690 | B2 * | 3/2019 | Adams | A63F 5/007 |
| 2012/0061912 | A1 * | 3/2012 | Sorge | A63F 5/00 273/142 E |
| 2012/0115563 | A1 * | 5/2012 | Kido | G07F 17/3211 463/17 |
| 2013/0053119 | A1 * | 2/2013 | Sharoni | A63F 3/00157 463/17 |

* cited by examiner

*Primary Examiner* — Benjamin Layno
(74) *Attorney, Agent, or Firm* — Newman Law, LLC

(57) ABSTRACT

Systems, methods and apparatus which provides for a modified roulette wheel apparatus and associated wagering games.

17 Claims, 3 Drawing Sheets

MODIFIED ROULETTE WHEEL APPARATUS AND ASSOCIATED WAGERING GAME METHODS

CROSS-REFERENCE TO RELATED APPLICATIONS

This application claims priority to U.S. Provisional Patent Application No. 61/927,835 filed Jan. 15, 2014, the disclosure of which is incorporated herein by reference.

BACKGROUND OF THE INVENTION

The invention is directed to wagering games, and more particularly, roulette games typically found in gaming establishments, such as those involving a roulette wheel, playing surface, playing positions for multiple players, playing cards, and a dealer, or virtual representations thereof.

Roulette is a well-known casino game which has been played for many years. A typical roulette game consists of a table with betting layout adjacent to a roulette wheel rotor or ring mounted for rotational motion within a support structure. The ring includes a circular array of numbered segments bearing numbers 1 through 36 defined on its upper surface. American Roulette wheels typically have rings which also include the numbers 0 and 00 disposed at diametrically opposite locations on the upper surface, whereas European Roulette wheels include only the number 0. The numbers 1 through 36 are not disposed in numerical order, but rather are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and/or 00 numbers, which are typically colored green. A ring of pockets corresponding in number to the plurality of numbers of the ring lies adjacent but radially inward of the number ring on the typical roulette wheel. A typical roulette wheel further includes an central cone and a circular, inclined ball track radially outwardly of the ring.

In operation of a typical roulette game, players place chips or tokens on a betting layout located on a roulette table, and then the croupier or dealer spins the roulette wheel and the roulette ball is placed in motion along the circular ball track in the opposite direction of the rotation of the wheel. As the wheel slows, the ball moves radially inwardly and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

SUMMARY OF THE INVENTION

In some embodiments, the invention is generally directed to a system and method for providing a roulette game, and various wagering options, in which a plurality of arcuate colored panels or strips are affixed on a roulette wheel to form a circle. In some embodiments, the arcuate colored panels provide a gradient of color within each color family.

Some embodiments are directed to a roulette wheel apparatus including a central axis about which the roulette wheel having rotates, the roulette wheel including a plurality of circumferentially spaced pockets for receiving a roulette ball therein, a radially outer annular rim, a lower ball track and a radially inner cone, an improvement comprising a planar ring mounted on a circular surface portion at a radial position between the central axis and the annular rim of the wheel apparatus, wherein the planar ring is comprised of a plurality of arcuate members, each of the arcuate members including indicia thereon, the indicia including at least one unique indicia corresponding radially with respect to each of at least one of the pockets.

In some embodiments, the indicia comprises colors.

In some embodiments, each of the unique indicia comprises a shade or tint of a color.

In some embodiments, each of the arcuate members includes a plurality of shades or tints of a color.

In some embodiments, at least two unique indicia correspond radially with respect to one of the plurality of pockets.

In some embodiments, one or more of the arcuate members of the plurality of arcuate members is mounted at an overlapping radial position with respect to one or more other arcuate members of the plurality of arcuate members.

In some embodiments, the planar ring is mounted within the plurality of pockets.

In some embodiments, the planar ring is mounted on the cone.

In some embodiments, the planar ring is mounted on the lower ball track.

Some embodiments of the invention are directed to a roulette wheel apparatus having a central axis about which the roulette wheel having rotates, the roulette wheel including a plurality of circumferentially spaced pockets for receiving a roulette ball therein, a radially outer annular rim, a lower ball track and a radially inner cone, the apparatus comprising a planar ring mounted on a circular portion of the cone at a radial position adjacent to the plurality of circumferentially spaced pockets, wherein the planar ring is comprised of a plurality of arcuate members, each of the arcuate members including indicia thereon, the indicia including at least one unique indicia corresponding radially with respect to each of at least one of the pockets.

In some embodiments, the indicia comprises colors.

In some embodiments, each of the unique indicia comprises a shade or tint of a color.

In some embodiments, each of the arcuate members includes a plurality of shades or tints of a color.

In some embodiments, at least two unique indicia correspond radially with respect to one of the plurality of pockets.

In some embodiments, one or more of the arcuate members of the plurality of arcuate members is mounted at an overlapping radial position with respect to one or more other arcuate members of the plurality of arcuate members.

Some embodiments of the invention are directed to a roulette wheel apparatus having a central axis about which the roulette wheel having rotates, the roulette wheel including a plurality of circumferentially spaced pockets for receiving a roulette ball therein, a radially outer annular rim, a lower ball track and a radially inner cone, the apparatus comprising a planar ring mounted on a circular portion of the cone at a radial position adjacent to the plurality of circumferentially spaced pockets, wherein the planar ring is comprised of a plurality of arcuate members, each of the arcuate members including indicia thereon, the indicia including at least one unique indicia corresponding radially with respect to each of at least one of the pockets, and wherein at least two unique indicia correspond radially with respect to one or more of the plurality of pockets.

In some embodiments, the indicia comprises colors, and in other embodiments each of the unique indicia comprises a shade or tint of a color.

In some embodiments, each of the arcuate members includes a plurality of shades or tints of a color.

In some embodiments, at least two unique indicia correspond radially with respect to one of the plurality of pockets.

DETAILED DESCRIPTION OF SOME EMBODIMENTS OF THE INVENTION

In the following detailed description, reference is made to the accompanying drawings which form a part of this application. The drawings provide and illustrate specific exemplary embodiments in which the invention may be practiced. It is to be understood that other embodiments may be utilized and structural changes may be made without departing from the scope of the invention.

Figure 1:
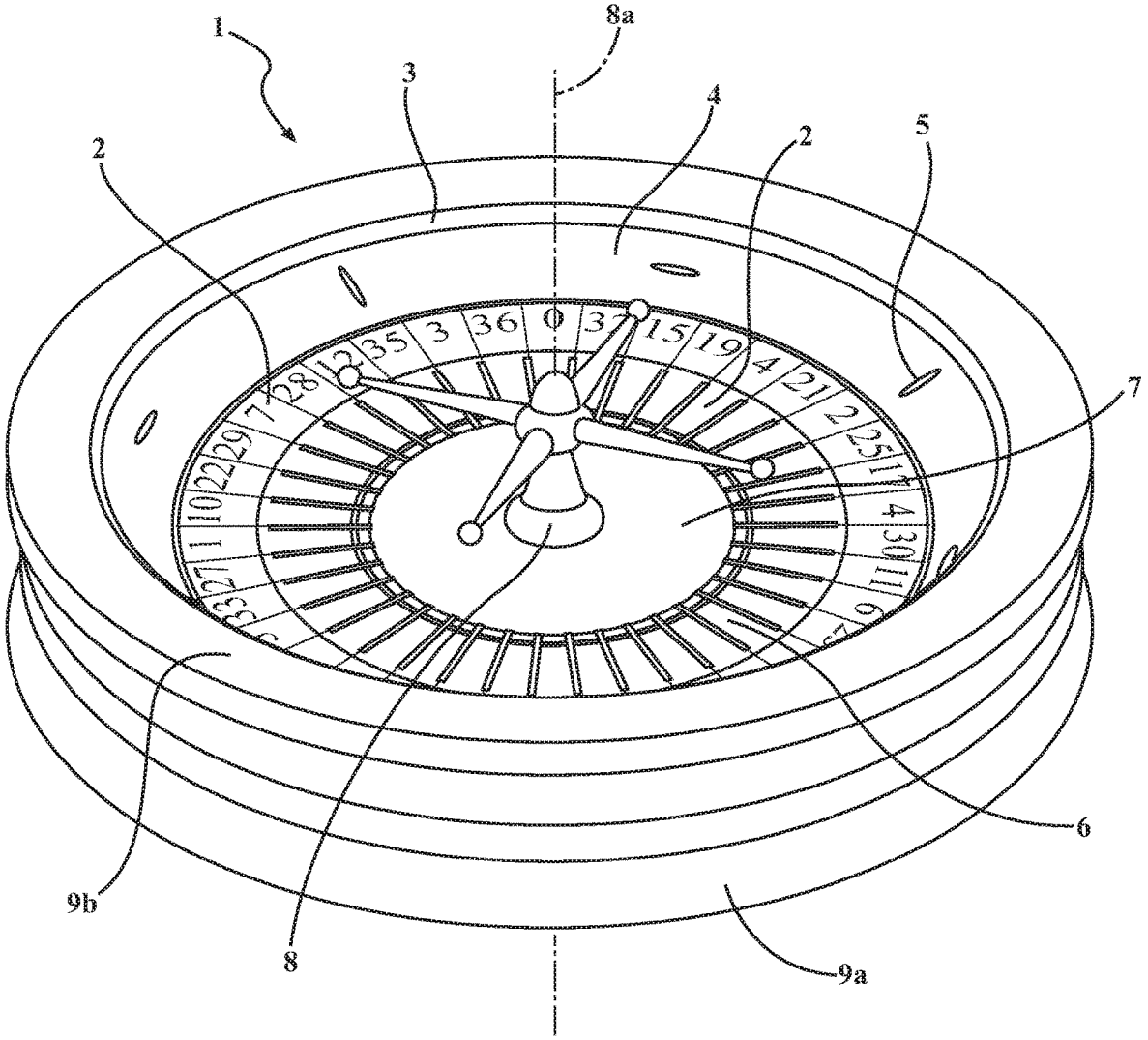
FIG. 1 is a perspective view of a conventional roulette wheel.

FIG. 1 shows a conventional American style roulette wheel apparatus 1. To play roulette, the croupier first spins the wheel 2 in one direction and then spins a ball in upper ball track 3 in the opposite direction of the spinning wheel 2. Upper ball track 3 is slightly tilted toward the center, so that as the ball slows in the upper ball track 3, gravity will cause the ball to fall out onto the lower ball track 4. Rigidly mounted on the lower ball track are horizontal and vertical ball deflectors 5 designed to disrupt the smooth path of the ball and add a random variable to the path of the ball. As the ball continues to slow, gravity causes it to move toward the wheel 2. Wheel 2 includes thirty-eight circumferentially positioned pockets 6 formed by pocket dividers creating a space for a ball to fall therein. The ball may then fall into any pocket 6, hit a pocket divider and bounce either back onto lower ball track 4, onto cone 7 or into another pocket 6. Eventually a ball will fall into a pocket 6 and stay there. The winning number is the number associated with the pocket in which the ball finally comes to rest. Turret 8 is primarily decoration that covers internal parts which may relate to a central spindle (not shown) at a central axis 8*a* extending longitudinally through turret upon which wheel 2 is mounted. All of the various parts are supported and contained in a stationary bowl 9*a* having an upper annular rim 9*b* at a radially outer position relative to the central axis 8*a*.

Figure 2:
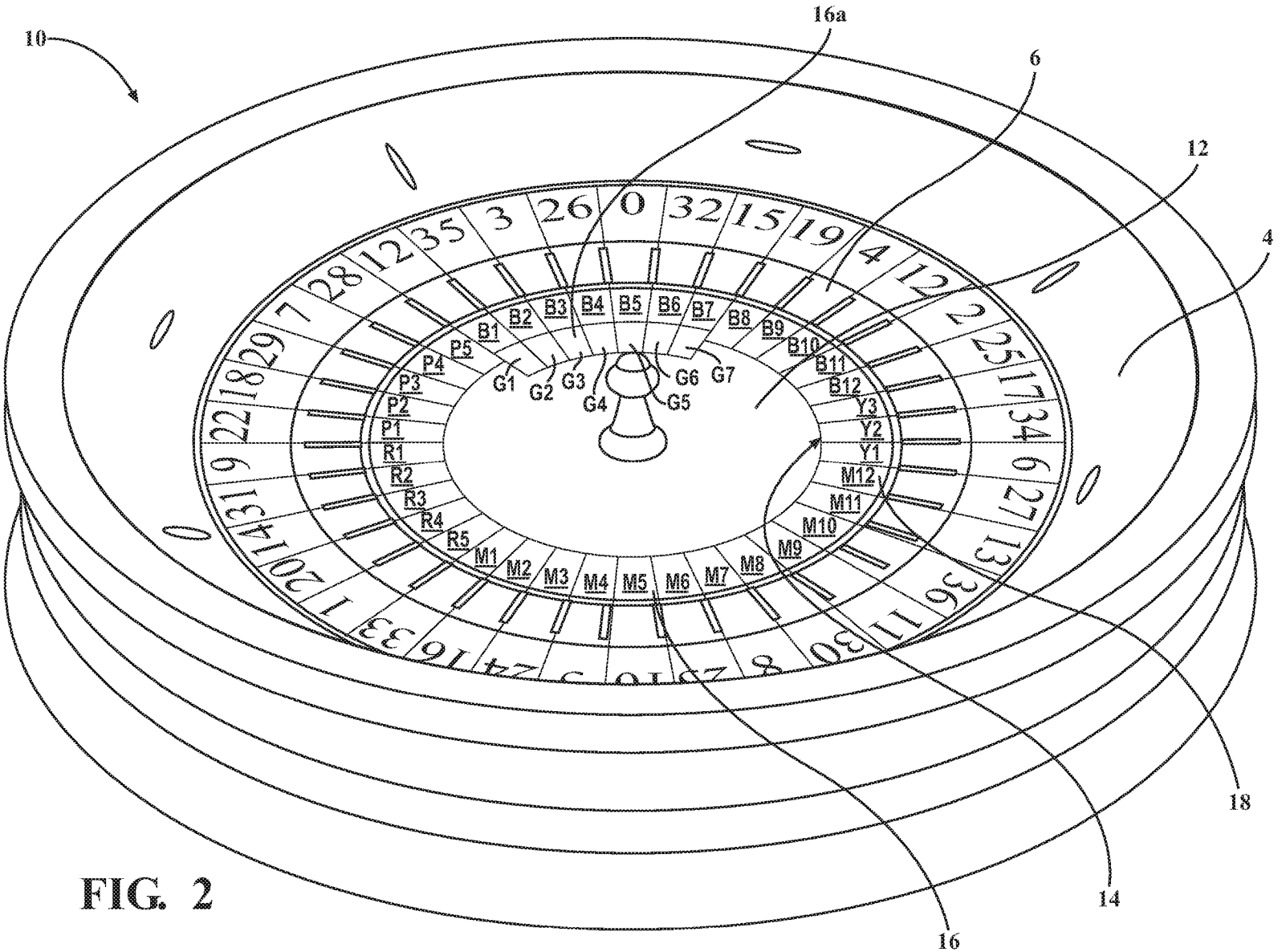
FIG. 2 is perspective view of an exemplary roulette wheel apparatus constructed in accordance with some embodiments of the invention.

FIG. 2 illustrates an exemplary embodiment of a roulette wheel apparatus constructed in accordance with the invention and generally referred to by reference numeral 10. Wheel apparatus 10 includes a cone 12 having an annular ring 14 mounted thereon. In this embodiment, annular ring 14 is mounted at a radially outer position of cone 12 adjacent to he plurality of circumferentially positioned pockets 6. Annular ring 14 may be mounted by being adhered on the surface of cone 12 or embedded within a corresponding annular indentation (not shown) created in cone 12 for receiving annular ring 14 therein. It should be readily apparent that annular ring 14 may be mounted at other locations in wheel apparatus 10, such as lower ball track 4 or in pockets 6 for example.

Annular ring 14 is composed of and includes arcuate members 16 which are further composed of various indicia positioned circumferentially about ring 14. The indicia includes at least one uniquely identifiable or distinguishable indicium 18 positioned radially with respect to each pocket on the roulette wheel. In other words, a uniquely identifiable indicium of the indicia is positioned along a radius from the central axis of roulette wheel apparatus 10.

Figure 3:
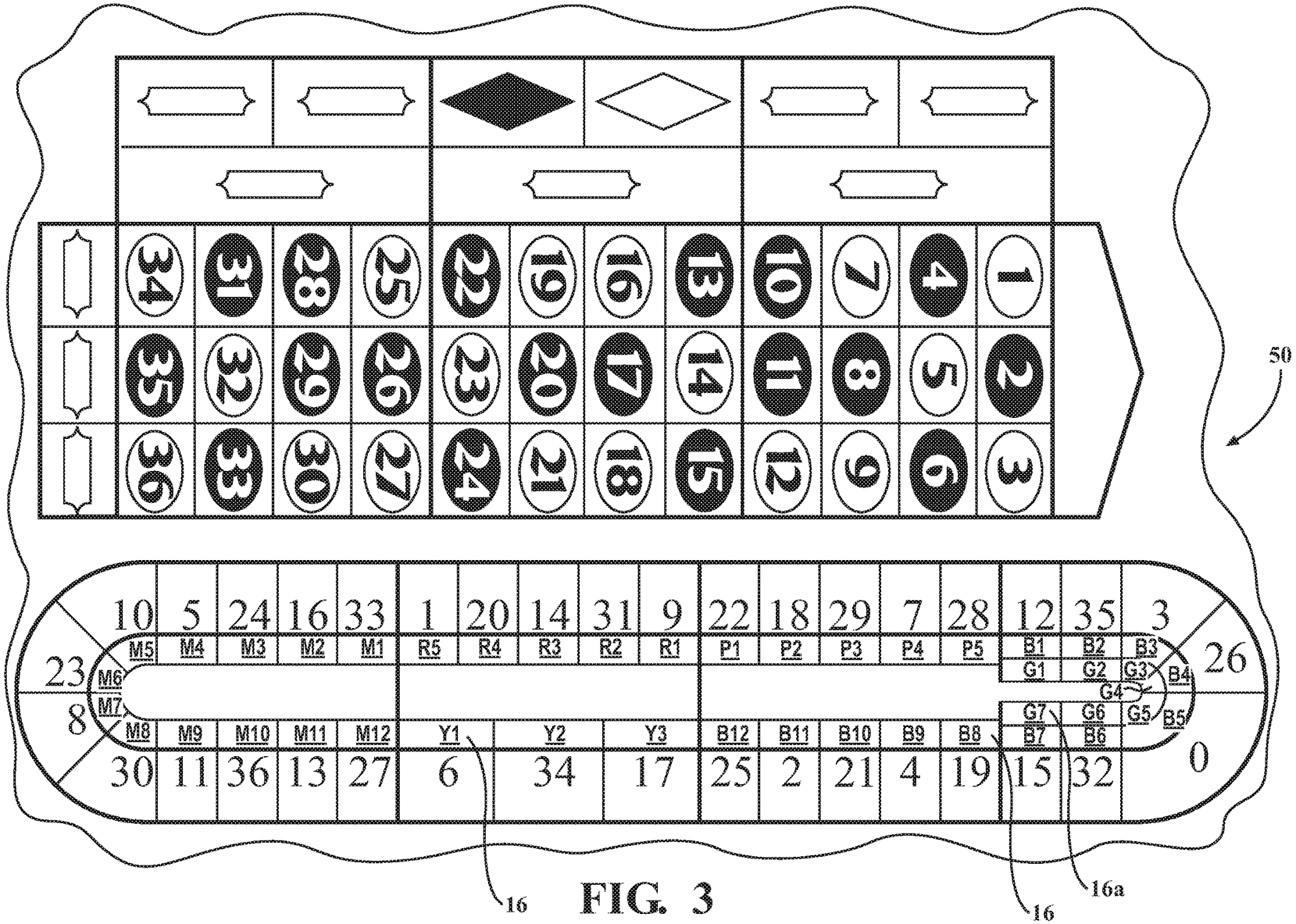
FIG. 3 is a top view of the exemplary roulette table layout for use with the roulette wheel apparatus shown in FIG. 2.

In this embodiment, the indicia are colors and the indicium are shades or tints of a color, which for illustrative purposes is identified in FIG. 2 as being alphanumeric values. For example, B1 through B12 may represent twelve distinguishable shades of the color blue, P1 through P5 may represent five distinguishable shades of the color orange, R1 through R5 may represent five distinguishable shades of the color red, M1 through M12 may represent twelve distinguishable shades of the color purple and G1 through G7 may represent seven distinguishable shades of the color green. In addition to corresponding radially to pockets on wheel apparatus 10, as shown in FIG. 3, each shade of color (or other indicia) may be depicted on a table layout 50. Thus, the same indicium may be used to help identify winning numbers as well as receive additional wagers. While the indicia are shown as being divided by lines in FIG. 2, it should be readily apparent that each indicium position 18 may change visually or be gradually blended into the adjacent positions 18 so that a gradient of color across each arcuate member 16 is formed. In this embodiment, an arcuate member 16 may be mounted in a radially inner or outer position to overlap another radially inner or outer member, as identified by numeral 16*a*. For example, wagers placed on B1 and G1 locations on layout 50 would win if the roulette outcome is 12.

It should be readily apparent that the indicia may be any visually distinguishable mark, such as patterns, text, characters or symbols.

In some embodiments, arcuate members 16 may be configured to correspond with wagers known as "French" or "European" bets, that is, the wagers known as Teir, Orphelins, Voisin, Zero Speil, and which may be modified to simplify the payouts to even multiple payouts facilitated by the overlapping arcuate member 16*a*.

Some embodiments of the invention are directed to an apparatus for retrofitting an existing roulette wheel assembly with a cone 12. It should be understood that systems such as those described herein may be adapted and configured to function independently or may also interact with other systems or applications, such as for example, a casino management system or player tracking system.

Those skilled in the art will readily appreciate that any of the systems and methods of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The system of the invention may be provided on electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to play the game as described herein.

It should be understood that the aforementioned embodiments of the invention may be incorporated in a fully or partially automated or interactive, computerized platform supporting multiple player positions and wagering. It should be readily apparent that additional computerized or manual systems may also be employed in accordance with the invention in order to achieve its full implementation as a system, apparatus or method. It should also be understood that any type of ball may be used, such as standard or non-standard roulette balls.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. In a roulette wheel apparatus including a central axis about which the roulette wheel having rotates, the roulette wheel including a plurality of circumferentially spaced pockets for receiving a roulette ball therein, a plurality of numbers, each pocket including one unique number, wherein each number corresponding radially with respect to each of the pockets, a radially outer annular rim, a lower ball track and a radially inner cone, an improvement comprising a planar ring mounted on a circular surface portion at an inner radial position between the central axis and the annular rim of the wheel apparatus, wherein the planar ring forms an arc in a concentric position with respect to the circumferentially spaced pockets and is comprised of a plurality of arcuate members, each of the arcuate members including indicia thereon, and each of the indicia on an arcuate member being separate and distinct from each of the numbers and corresponding radially with respect to one or more of the pockets, wherein the plurality of arcuate members are separate and distinct from each of the pockets, and wherein each of the indicia on each of the plurality of arcuate members is in an overlapping radial position with one or more pockets.

2. The roulette wheel apparatus of claim 1, wherein each of the indicia on the plurality of arcuate members comprises a unique color.

3. The roulette wheel apparatus of claim 1, wherein each of the indicia on the plurality of arcuate members comprises a different color, each indicia further comprising a plurality of indicium, wherein each of the indicium is a unique gradient of a color.

4. The roulette wheel apparatus of claim 1, wherein at least two unique indicia correspond radially with respect to one of the plurality of pockets.

5. The roulette wheel apparatus of claim 1, wherein the planar ring is mounted within the plurality of pockets.

6. The roulette wheel apparatus of claim 1, wherein the planar ring is mounted on the cone.

7. The roulette wheel apparatus of claim 1, wherein the planar ring is mounted on the lower ball track.

8. A roulette wheel apparatus having a central axis about which the roulette wheel having rotates, the roulette wheel including a plurality of circumferentially spaced pockets for receiving a roulette ball therein, a plurality of numbers, each pocket including one unique number, wherein each number corresponding radially with respect to each of the pockets, a radially outer annular rim, a lower ball track and a radially inner cone, the apparatus comprising a planar ring mounted on a circular portion of the cone at an inner radial position adjacent to the plurality of circumferentially spaced pockets, wherein the planar ring is comprised of a plurality of arcuate members, each of the arcuate members forming an arc being in a concentric position with respect to the circumferentially spaced pockets and including indicia thereon, the indicia including at least one unique indicium corresponding radially with respect to each of the pockets, wherein each of the indicia is separate and distinct from each of the numbers, a first arcuate member of the plurality of arcuate members being mounted adjacent to a second arcuate member of the plurality of arcuate members, wherein at least one indicium on the first arcuate member and at least one indicium on the second arcuate member are in a radially overlapping position with respect to same pocket.

9. The roulette wheel apparatus of claim 8, wherein the indicia comprises colors.

10. The roulette wheel apparatus of claim 8, wherein each of the unique indicia comprises a shade or tint of a color.

11. The roulette wheel apparatus of claim 8, wherein each of the arcuate members includes a plurality of shades or tints of a color.

12. The roulette wheel apparatus of claim 8, wherein at least two unique indicia correspond radially with respect to one of the plurality of pockets.

13. A roulette wheel apparatus having a central axis about which the roulette wheel having rotates, the roulette wheel including a plurality of circumferentially spaced pockets for receiving a roulette ball therein, a plurality of numbers, each pocket including one unique number, wherein each number corresponding radially with respect to each of the pockets, a radially outer annular rim, a lower ball track and a radially inner cone, the apparatus comprising a planar ring mounted on a circular portion of the cone at an inner radial position adjacent and in a concentric relationship to the plurality of circumferentially spaced pockets, wherein the planar ring is comprised of a plurality of arcuate members, each of the arcuate members being in a concentric relationship with each other and the circumferentially spaced pockets and including indicia thereon, the indicia including at least one unique indicia corresponding radially with respect to each of at least one of the pockets, wherein each of the indicia is separate and distinct from each of the numbers, and wherein at least two unique indicia are positioned radially apart relative each other and to correspond radially with respect to a single pocket of the plurality of pockets, wherein one of the at least two unique indicia is on a first arcuate member and the other of the at least two unique indicia is on a second arcuate member, wherein the first and second arcuate members are mounted at an overlapping radial position with respect to each other.

14. The roulette wheel apparatus of claim 13, wherein the indicia comprises colors.

15. The roulette wheel apparatus of claim 13, wherein each of the unique indicia comprises a shade or tint of a color.

16. The roulette wheel apparatus of claim 13, wherein each of the arcuate members includes a plurality of shades or tints of a color.

17. The roulette wheel apparatus of claim 13, wherein at least two unique indicia correspond radially with respect to one of the plurality of pockets.

* * * * *